United States Patent [19]

McNeely

[11] 4,040,567

[45] Aug. 9, 1977

[54] HEATING UNIT

[75] Inventor: Charles D. McNeely, Uniontown, Ohio

[73] Assignee: NEPRO, Inc., Uniontown, Ohio

[21] Appl. No.: 620,769

[22] Filed: Oct. 8, 1975

Related U.S. Application Data

[62] Division of Ser. No. 544,276, Jan. 27, 1975, Pat. No. 3,941,311.

[51] Int. Cl.[2] ..... F24D 1/02

[52] U.S. Cl. ..... 237/81

[58] Field of Search ..... 252/67, 78; 237/1 SL, 237/8 B, 81; 219/365, 341; 165/105

[56] References Cited

U.S. PATENT DOCUMENTS

| | | | |
|---|---|---|---|
| 3,210,005 | 10/1965 | Arnold | 219/365 X |
| 3,933,198 | 1/1976 | Hara et al. | 165/105 X |

OTHER PUBLICATIONS

Condensed Chemical Dictionary, 14th ed. Reinhold Publishing Co., 1964, p. 865.

Textbook of Organic Chemistry, D. Van Nostrand Co., Inc., 1958, p. 94.

*Primary Examiner*—William E. Wayner

*Assistant Examiner*—William E. Tapolcai, Jr.

*Attorney, Agent, or Firm*—Hamilton, Renner & Kenner

[57] ABSTRACT

Disclosed is a heating unit consisting of a boiler chamber in which a two-phase liquid system is placed under a slight vacuum and supplied with a source of thermal energy. The activation of the source of thermal energy causes the lower phase liquid to vaporize and percolate through the upper phase liquid and circulate into a radiator section made up of finned tubes with an air flow being directed thereacross. The air flow absorbs the heat of the vapor which then is directed to the areas to be heated. The vapor continues to circulate into a header where the vapor is condensed back to the liquid state by a plurality of finned condensation tubes inside the header. The finned tubes of the radiator section have 90° elbows extending upwardly into the header to prevent any condensed liquid from returning into the radiator of the system, and directing the vapor toward the coldest side of the header so as to enhance the condensation process. The liquid is returned to the boiler chamber via a return line with a one-way gate, thereby creating a one-way circulation within the system which promotes higher efficiency. The two-phase liquid system is made up of two non-miscible liquids, the lower one having a higher specific gravity, a low specific heat, and a boiling point above 200° F., such as tetrachloroethene. The upper liquid has a lower specific gravity, a relatively high specific heat and high boiling point relative to the lower liquid such as an oil. The upper phase is kept to a thin layer such that it completely covers the lower phase but does not unduly hamper percolation of the lower phase therethrough as it is vaporized.

4 Claims, 4 Drawing Figures

HEATING UNIT

This is a division of application Ser. No. 544,276, filed Jan. 27, 1975, now U.S. Pat. No. 3,941,311.

BACKGROUND OF THE INVENTION

The invention relates to a heating unit utilizing a two-phase liquid heat transfer system in a boiler heat exchanger structure to provide greater efficiency and thereby save energy. More specifically, the heating unit has a boiler chamber in which the lower phase liquid is vaporized and percolated through the upper phase liquid into a radiator where heat transfer to an airflow thereacross occurs. Thereafter the vapor continues its circulation by entering a header where the vapor is condensed back to the liquid state and returned to the boiler chamber to repeat the cycle.

There are available today a large number of differing designs for heating units of varying efficiencies, most of which can be grouped into three major areas of design concept, mainly the hot water or steam circulation type, the forced air type, and the newer heat pump type.

The hot water or steam circulation type probably is the most efficient type available today in over all performance. The most popular is the hot water unit where the water is heated and circulated by an electric pump to base board radiators or radiant floor panels in the rooms of the structure to be heated. Some of the drawbacks of this type of system are: a more expensive and complicated initial installation mechanically and electrically due to the added piping, insulation therefor, electric pump and controls therefor, and the more numerous thermostatic controlled electric valves on the lines leading to various portions of the structure to be heated; because of the more complicated design, more maintenance to keep the system in operation; a lack of air circulation likely to cause stagnation; the noise nuisance of water bumping as the system is fired up; and a lack of ability to control the humidity of the air because these systems are closed. Because of its economics, this type of heating system finds wide acceptance in commercial construction today. Prior art directed toward boiler designs in this type of heating system which are of interest include U.S. Pat. Nos. 1,898,571; 2,154,021; 2,277,094; 2,508,736; 2,820,134; and, 3,210,005. Although the forgoing patents are addressed to the problems attendant the use of a boiler, none have achieved the results of the present invention.

The forced air type is probably the most popular type for the residential market. Air flow is directed across heating elements or a convector to heat the air to a point about 30° above the room temperature and then piped through air ducts to the rooms to be heated. Cold air intake registers supply this flow such that a complete air cycle is set up in the structure to be heated. This type of heating system has the advantage of being: simpler to install and maintain, usually cheaper to install; able to provide an easy way to control humidity in the structure; easily used for both heating in winter and cooling in summer with less alteration of equipment; able to provide good air circulation to prevent stagnation; and are generally quieter in operation. The major drawback of this type of heating system is its lower efficiency.

The newer heat pump type is gaining more acceptance in more temperate climates because it employs the advantages of a forced air system at a higher efficiency within a given temperature range. The heat pump is basically an air conditioner and is sized according to air conditioning capacity necessary for the given structure. It has a reversing valve to convert it to a heating unit. It operates as an air conditioner in that it employs two coils, one on each side of a compressor. The low pressure side coil absorbs heat which is emitted from the high pressure side coil. Air flow is directed across both coils to affect the heat transfer. The reversing valve is operated by a thermostat detecting outside temperature and controls which side is the high pressure coil. Also for winter operation a defrosting system is necessary on the outside coil because during the heating cycle, frost will deposit on the outside coil if the temperature of the coil falls below 32° F. If ice is allowed to build up the efficiency of the heat pump is significantly reduced. One defrost system directs hot gas from the compressor discharge to the outside coil long enough to melt any ice formation thereon. During this defrost cycle though, no heat is produced in the inside coil to heat the structure. This means that when the outside temperature falls much below 32° F., supplementary electric resistance heaters will be required, thereby reducing the efficiency as the temperature decreases. At peak efficiency conditions the heat pump can produce 8,500 btu's per kilowatt hour of electricity for a Coefficient of Performance of 2.489 based upon 1 kilowatt hour of electricity producing 3,414 btu's, the standard conversion factor. The major drawback of this type of heating system then is the narrow temperature range at which it maintains a high efficiency. Also, due to the fairly complex nature of this equipment, maintenance costs are higher and the high pressures involved can present a safety hazard.

SUMMARY OF THE INVENTION

It is an object of the present invention to provide a new heating system that consumes less energy to produce a given output to heat either residential or commercial structures.

It is a further object of the present invention to employ the advantages of the forced air duct work systems at this higher efficiency.

It is another object of the present invention to reduce the size of the basic unit necessary to produce the necessary heat for a structure.

It is a still further object of the present invention to provide a heating system that will maintain its efficiency and coefficient of performance over the entire conceivable temperature range encountered by a heating unit.

It is a further object of the present invention to provide a system with a higher safety margin than prior art designs.

Another object is to provide a simplified system that can be easily installed and maintained.

These and other objects of the present invention, together with the advantage thereof over existing and prior art forms which will become apparent from the description to follow, are accomplished by the improvements hereinafter described and claimed.

In general, a heating unit employing the concepts of the present invention includes a boiler chamber in which a two-phase liquid system is placed under a slight vacuum and supplied with a source of thermal energy, a radiator section having finned tubes communicating between the boiler chamber and a header section, the finned tubes terminating in 90° elbows inside the header section such that condensed liquid cannot return therethrough to the boiler chamber, a condensation system within the header section to condense the vapor emitting from the radiator section, and a return line with a one-way gate such that only one direction of circulation is possible within the heating unit.

One preferred and one alternate embodiment of the subject heating unit is shown by way of example in the accompanying drawings without attempting to show all of the various forms and modifications in which the invention might be embodied; the invention being measured by the appended claims and not by the details of the specification.

DESCRIPTION OF THE PREFERRED EMBODIMENT

Figure 1:
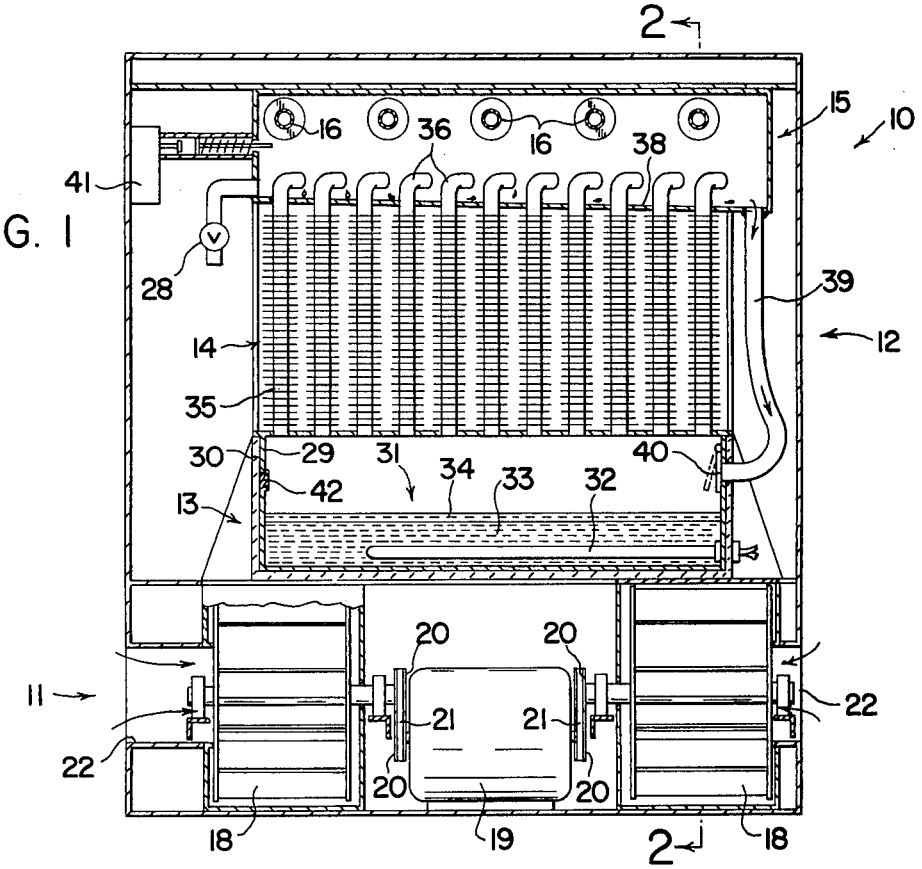
FIG. 1 is a front elevational view of a heating unit embodying the concepts of the present invention.

Referring to the drawings, a heating unit according to the present invention is indicated generally by numeral 10. It is made up of an air blower indicated generally by numeral 11 and the heat plant indicated generally by the numeral 12. The heat plant 12 has a boiler chamber 13, a radiator 14, and a header 15. In the header 15 are a plurality of condensation tubes 16 defining air passageways therethrough.

This type of heating unit can be connected to the conventional air duct systems commonly found in residential forced air furnace installations or small units can be placed in individual rooms to be heated such as in the rooms of a hotel or motel, thereby eliminating the need for extensive air duct systems on a building-wide basis. The units placed in individual rooms could easily be mounted in the walls or the ceiling, or built into a piece of furniture such as a night stand or a television stand to fit the room decor. Also, this unit can be operated with the radiator 14 in a horizontal position not shown in the drawings as long as a slight incline toward the header 15 is maintained.

The air blower 11 of the heating unit shown in the drawings contains a centrifugal fan 18 which is powered by an electric motor 19 through a set of pullies 20 and belt 21. These components may be mounted in the unit in any convenient manner consistent with recognized heating and air conditioning standards, one example being shown in the drawings. As seen in FIG. 1 of the drawings this particular heating unit 10 employs two centrifugal fans 18 with an air intake port 22 on each side of the unit to supply air to each centrifugal fan 18. A heating unit embodying the present invention could just as easily employ only an air intake port so as to accommodate the conventional air duct systems found in most residential forced air furnace installations today.

Figure 2:
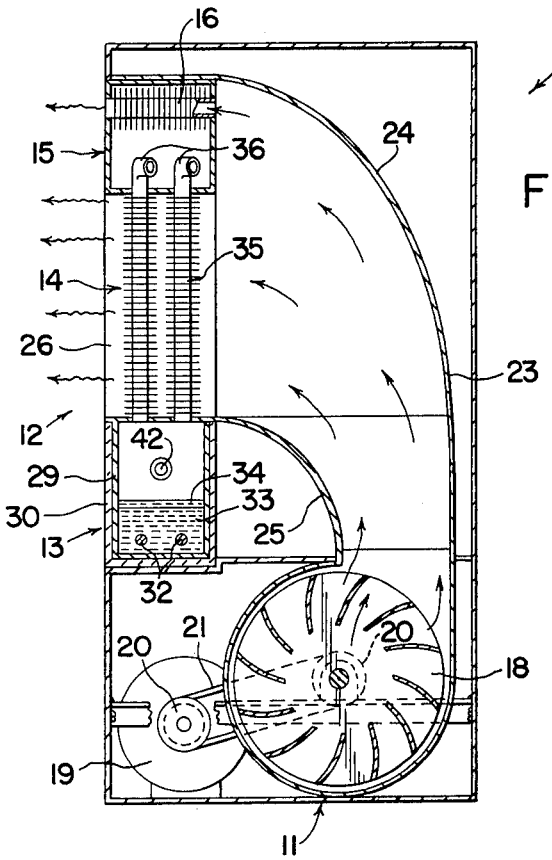
FIG. 2 is a side section of the heating unit taken substantially on line 2—2 of FIG. 1, depicting the unit and the air flow therein during the operation of the heating unit.
Figure 3:
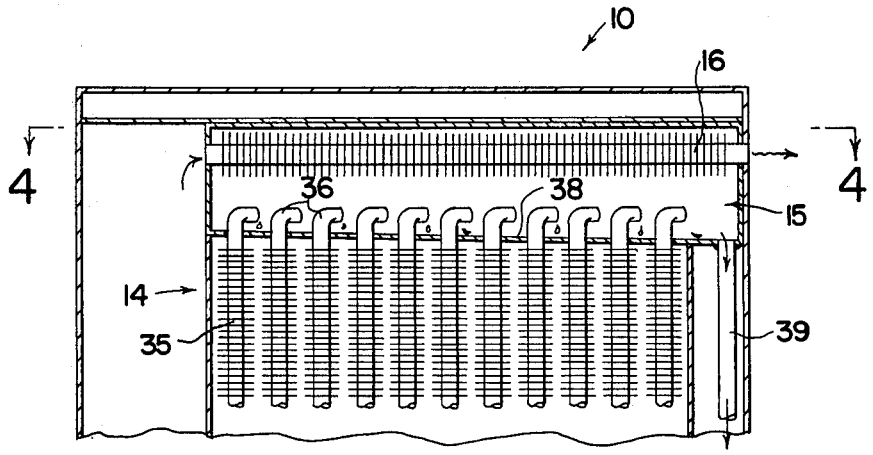
FIG. 3 is a front elevational sectional view, showing a second embodiment of the condensation tube orientation; and, FIG. 4 is a top section of FIG. 3 taken substantially alone line 4—4 of FIG. 3, depicting the condensation tubes in the header.
Figure 4:
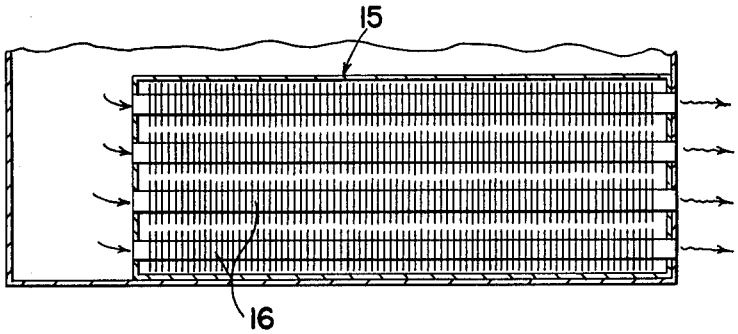

As shown in FIGS. 1 and 2 of the drawings the air output of the centrifugal fans 18 is directed into an air duct 23 with a rounded heel 24 and a rounded throat 25 so as to direct the air flow through radiator 14 and through the condensation tubes 16 to the air outlet register 26. One skilled in the art will know that several alternate forms of this structure are readily available for a low air pressure system such as the use of turning vanes to direct the air flow. Also it is common knowledge in the heating and air conditioning trade that if a high air pressure system is employed, no internal air ducts are necessary. In this instance the only requirement is that the shell of the unit be sealed to act as a plenum thereby allowing the air pressure to escape at only the desired openings into an air duct system or the room to be heated. In the second embodiment shown in FIGS. 3 and 4 of the drawings, the circulation is altered slightly to insure airflow through the condensation tubes 16 in the header 15.

Returning to the heat plant 12 as shown in FIGS. 1 and 2 of the drawings, it can be seen that the heat plant 12 is a completely sealed system such that a vacuum can be pulled through valve 28. The boiler chamber 13 is made up of a steel pan 29 with a second sealed casing 30 surrounding the boiler to prevent escape of anything contained in the boiler chamber 13. This is commonly known in the trade as boiler lagging and is used mainly for safety considerations. Contained within the boiler chamber 13 as shown in the drawings is a two-phase liquid system 31 and an electrical resistance heating element 32. Electrical resistance heating elements were employed in the unit as shown to reduce the size of the unit, to eliminate the need for an exhaust system to carry off combustion by-products and for general convenience in experimentation on the unit. A fired boiler chamber as by oil, gas, wood or coal would be capable of accomplishing essentially the same results as the heating unit 10 shown and described in detail herein.

The two-phase liquid system 31 is made up of two liquids which are relatively non-miscible. The lower phase liquid 33 is the heating fluid of the heating unit. It must be a liquid of a higher specific gravity than the upper phase liquid 34. It is also desirable that such liquid have a relatively low specific heat and heat of vaporization. Another factor to be considered is that this liquid have a high enough boiling point as to maintain the temperature of the radiator section 14 high enough to cause the given air flow thereacross to rise 30° or more in temperature. It has been found by experimentation that tetrachloroethane is an excellent choice for the lower phase liquid 34. This compound has a boiling point of 249.7° F., a specific gravity of 1.619 at 77° F., a heat of vaporization of 90.2 b.t.u. per pound and a specific heat of 0.21 b.t.u. per pound per degree F. This compound is safe because it has no flash point and no fire point. The upper phase liquid 34 must have a lower specific gravity than the lower phase liquid 33 so that it will float on top of the lower phase liquid, have a relatively high specific heat and have such a high boiling point that the upper phase liquid 34 will remain in the liquid state during the operation of the heating unit 10 throughout its range of operating temperatures. It has been found by experimentation that almost any oil is an excellent choice for the upper phase liquid 34.

During the operation of the heating unit 10, a thin layer of the upper phase liquid 34 must completely cover the surface of the lower phase liquid 33 so that the lower phase liquid 33 will percolate therethrough upon vaporizing. This upper phase liquid 34 then tends to seal the heat of the power source in the lower phase liquid 33 to accomplish a concentration of heat during the operation of the heating unit 10 and to retain the heat remaining in the lower phase liquid 33 when the unit is shut down for longer periods of time than would otherwise be expected. The use of two organic liquids solves a major drawback of previous hot water systems in that the present system eliminates corrosion or coil liming, a cause of many breakdowns of the hot water or steam type heating systems. It is believed that part of the reason for the unexpected efficiency realized by his heating unit is the fact that the tetrachloroethane has a specific heat less than that of water at 1.00 or average air at 0.24. In addition, the upper phase liquid 34 prevents much heat loss associated with other systems as explained above. The compactness of the heating unit and its design also help its efficiency.

Connected to the top of the boiler chamber 13 is the radiator 14 where the heat is transferred from the hot vapor of the lower phase liquid 33 to an air flow across the radiator 14 powered by the air blower 11 described in detail above. The radiator 14 is made up of a plurality of finned tubes 35 which are connected flush to the top of the boiler chamber so to communicate therewith. These finned tubes 35 present the maximum possible surface area for heat transfer. At the other end of the radiator 14, the finned tubes 35 are connected to the header 15 so as to provide a passageway between the boiler chamber 13 and the header 15. Note in FIG. 1 that each finned tube 35 has a 90° elbow 36 connected thereto and extending upwardly into the interior of the header 15 such that condensate cannot drop back down into the radiator 14, thereby decreasing the efficiency of the present heating unit. Also, these 90° elbows 36 are used to direct the eminating vapor toward the coldest side wall of the header 15 against which the airflow is directed, to greatly enhance the condensation process. Usually this will be the header 15 side wall facing the airflow from the air blower 11. The bottom 38 of the header 15 is slanted slightly toward the return line 39 to enhance the one-way circulation within the heat plant 12. Positioned above the outlet, 90° elbows 36 in the header 15 are condensation tubes 16 which are also of the finned tube design. In FIGS. 1 and 2, condensation tubes 16 are connected between the side walls of the header 15 to provide a passageway for air to pass from one side to the other sealed off from the atmosphere interior of the header 15. As seen in the second embodiment shown in FIGS. 3 and 4 of the drawings, these condensation tubes 16 can be run across the length of the header 15 instead of the width as shown in FIGS. 1 and 2 of the drawings to accomplish the same result. The condensation tubes 16 cause the lower phase liquid 33 vapor which does not condense on the header 15 side wall to condense for return to the boiler chamber 13 and transfer more heat to the air flow through the heating unit 10.

The return line 39 is connected to the bottom of the header 15 at its lowest point so as to allow drainage of all the condensate into the return line 39. At the other end, the return line 39 is connected to the wall of the boiler chamber 13 above the liquid level of both phases so as to define a passageway between the header 15 and the boiler chamber 13. At the point where the return line 39 enters the boiler chamber 13, there is a one-way gate 40 which allows the lower phase liquid 33 to flow back into the boiler chamber 13 but prevents the migration of any vapor into the return line 39 which would disrupt the one-way circulation cycle necessary for the efficient operation of the present heating unit 10.

As stated above, the heat plant 12 operates under a slight vacuum. Through experimentation it has been found that for the particular fluid system herein described, a vacuum of 15 to 18 inches of water is optimum for efficient operation. A higher vacuum of say 24 to 25 inches of water does not provide as good a result. The valve 28 can be used to draw the vacuum on the heat plant 12 interior.

A vacuum detection switch 41, of conventional manufacture, is employed in the heat plant 12 to automatically shut down the heating unit 10 when the vacuum in the system drops to a predetermined level. The switch removes the power source from the boiler chamber 13. This safety device insures that no pressure will build up in the heating unit.

Another safety device employed is a soft plug 42 in the boiler chamber 13 above the liquid level of both phases, which will release into the sealed casing 30 surrounding the boiler chamber 13 upon the build up of a predetermined amount of gauge pressure in the heating unit 10.

A heating unit constructed and operated according to the description of the preferred embodiment above, will produce a Coefficient of Performance of approximately 2.73, which exceeds the heat pump with a Coefficient of Performance of 2.489. This efficiency and compactness of design will allow the use of significantly smaller units to provide the same given heating capacity of prior art forms.

Thus, it should be apparent from the foregoing description of the preferred embodiment that the device herein described accomplishes the objects of the invention.

What is claimed is:

1. A method for facilitating heat transfer in a heating unit comprising the steps of:

providing a lower phase liquid having a specific heat less than unity and a boiling point greater than 200° F;

floating an upper phase liquid upon the lower phase liquid;

heating and vaporizing the lower phase liquid whereby the vapor percolates through said upper phase liquid; and, circulating the vapor of the lower phase liquid throughout the heating unit to transfer heat.

2. A method according to claim 1, wherein the upper phase liquid consists of a liquid being relatively nonmiscible with the lower phase liquid and having a specific gravity less than that of the lower phase liquid, and a boiling point higher than that of the lower phase liquid, including the additional step of:

drawing a slight vacuum through the heating unit.

3. A method according to claim 1, wherein the lower phase liquid is tetrachloroethene.

4. A method according to claim 1, wherein the upper phase liquid is an oil.

* * * * *